US010806200B2

(12) United States Patent
Park

(10) Patent No.: US 10,806,200 B2
(45) Date of Patent: Oct. 20, 2020

(54) UNIFORM FOR PROTECTION FROM FOREIGN MATTER

(71) Applicant: Hyoungkil Park, Chuncheon-si (KR)

(72) Inventor: Hyoungkil Park, Chuncheon-si (KR)

( * ) Notice: Subject to any disclaimer, the term of this patent is extended or adjusted under 35 U.S.C. 154(b) by 34 days.

(21) Appl. No.: 16/317,287

(22) PCT Filed: Jan. 17, 2017

(86) PCT No.: PCT/KR2017/000559
§ 371 (c)(1),
(2) Date: Jan. 11, 2019

(87) PCT Pub. No.: WO2018/021638
PCT Pub. Date: Feb. 1, 2018

(65) Prior Publication Data

US 2019/0223529 A1 Jul. 25, 2019

(30) Foreign Application Priority Data

Jul. 27, 2016 (KR) ..... 10-2016-0095142

(51) Int. Cl.
*A41D 29/00* (2006.01)
*A41B 1/08* (2006.01)
(Continued)

(52) U.S. Cl.
CPC ..... *A41D 29/00* (2013.01); *A41B 1/08* (2013.01); *A41D 1/08* (2013.01); *A41F 1/00* (2013.01);
(Continued)

(58) Field of Classification Search
CPC ..... A41D 29/00; A41D 1/08; A41D 2600/10; A41D 13/00; A41D 13/05; A41D 13/055;
(Continued)

(56) References Cited

U.S. PATENT DOCUMENTS 187,405 A * 2/1877 Moulton ..... A41D 3/00 2/108
1,204,719 A * 11/1916 Van Heusen ..... A41D 10/00 2/83
(Continued)

FOREIGN PATENT DOCUMENTS

JP 09-122288 A 5/1997
KR 20-1998-0059458 U 10/1998
(Continued)

*Primary Examiner* — Khaled Annis
*Assistant Examiner* — Dakota Marin
(74) *Attorney, Agent, or Firm* — Rabin & Berdo, P.C.

(57) ABSTRACT

The present invention relates to a functional uniform for preventing foreign matters from being introduced therein, while a wearer is playing sports, and the uniform, which is separated into a top and a bottom, includes: the top having a non-exposed lower part having side slits and an exposed upper part having no side slits, the non-exposed part having a back surface portion located on the back side thereof with respect to the side slits in such a manner as to be inserted into the bottom at the time when the uniform is worn and a front surface portion located on the front side thereof with respect to the side slits in such a manner as to be disposed on the outside of the bottom at the time when the uniform is worn, the front surface portion having at least two or more pulling slots formed long in up and down directions on the upper side thereof in such a manner as to pull out belt loops disposed on the bottom toward the outside of the top and first fixing members disposed on the lower side thereof under the pulling slots, and the bottom having second fixing members disposed thereon in such a manner as to correspond to the first fixing members, wherein in a state where the lower side of the front surface portion of the top under the pulling slots is folded, the first fixing members are fastened or attached to the second fixing members of the bottom, so that the lower side of the front surface portion is fixed to the bottom.

4 Claims, 8 Drawing Sheets

(51) Int. Cl.

| | |
|---|---|
| ***A41D 1/08*** | (2018.01) |
| ***A41F 1/00*** | (2006.01) |
| *A41F 5/00* | (2006.01) |
| *A41D 13/00* | (2006.01) |
| *A41D 13/05* | (2006.01) |
| *A41D 27/04* | (2006.01) |
| *A41F 1/02* | (2006.01) |
| *A41B 1/06* | (2006.01) |
| *A41B 1/10* | (2006.01) |
| *A41F 9/00* | (2006.01) |

(52) U.S. Cl.
CPC . *A41B 1/06* (2013.01); *A41B 1/10* (2013.01); *A41D 13/00* (2013.01); *A41D 13/05* (2013.01); *A41D 13/055* (2013.01); *A41D 13/0562* (2013.01); *A41D 13/0568* (2013.01); *A41D 27/04* (2013.01); *A41D 2300/30* (2013.01); *A41D 2300/32* (2013.01); *A41D 2600/10* (2013.01); *A41F 1/02* (2013.01); *A41F 5/00* (2013.01); *A41F 9/007* (2013.01)

(58) Field of Classification Search
CPC ..... A41D 13/0562; A41D 13/0568; A41D 27/04; A41D 2300/30; A41D 2300/32; A41B 1/08; A41B 1/06; A41B 1/10; A41F 1/00; A41F 1/02; A41F 9/007; A41F 5/00
USPC ..... 2/70
See application file for complete search history.

(56) References Cited

U.S. PATENT DOCUMENTS

| | | | | | |
|---|---|---|---|---|---|
| 1,504,249 | A * | 8/1924 | Klein | A41D 7/00 | 2/70 |
| 1,531,984 | A * | 3/1925 | Schlissel | A41D 1/00 | 2/70 |
| 1,611,420 | A * | 12/1926 | Cuddy | A41D 13/02 | 2/79 |
| 2,641,764 | A * | 6/1953 | Fischer | A41B 13/00 | 2/70 |
| 4,236,658 | A * | 12/1980 | Kallman | A45F 5/00 | 224/250 |
| 5,084,914 | A * | 2/1992 | Hesch | A41D 13/129 | 2/227 |
| 5,105,478 | A * | 4/1992 | Pyc | A41D 27/28 | 2/115 |
| 5,754,982 | A * | 5/1998 | Gainer | F41H 1/02 | 2/102 |
| 6,088,831 | A * | 7/2000 | Jensen | F41H 1/02 | 2/117 |
| 6,185,745 | B1 * | 2/2001 | Alger | A41B 1/06 | 2/107 |
| 6,389,600 | B1 * | 5/2002 | Di Maio | A41B 9/06 | 2/115 |
| 7,398,558 | B1 * | 7/2008 | Kattenhorn | A41F 5/00 | 2/79 |
| 7,596,813 | B2 * | 10/2009 | Borowski | A41D 3/00 | 2/93 |
| 7,793,359 | B2 * | 9/2010 | Spiewak | A41D 1/002 | 2/247 |
| 7,845,024 | B2 * | 12/2010 | Hill | A41B 1/00 | 2/117 |
| 9,204,676 | B2 * | 12/2015 | Gbadamosi | A41D 27/201 | |
| 2005/0166300 | A1 | 8/2005 | Tanaka | | |
| 2007/0101477 | A1 * | 5/2007 | Grilliot | A41D 27/04 | 2/69 |
| 2011/0154555 | A1 * | 6/2011 | Messika | A41D 1/00 | 2/115 |
| 2015/0033439 | A1 * | 2/2015 | Dimotsantos | A41D 13/1236 | 2/114 |
| 2016/0324238 | A1 * | 11/2016 | Tran | A41F 5/00 | |

FOREIGN PATENT DOCUMENTS

| | | | |
|---|---|---|---|
| KR | 20-1999-0021854 | U | 6/1999 |
| KR | 20-0430110 | Y1 | 11/2006 |
| KR | 10-2008-0039365 | A | 5/2008 |

* cited by examiner (a)

(b)

(a)

(b)

(a)

(b)

UNIFORM FOR PROTECTION FROM FOREIGN MATTER

TECHNICAL FIELD

The present invention relates to a functional uniform for preventing foreign matters from being introduced therein, while a wearer is playing sports, and more particularly, to a uniform that is capable of preventing foreign matters such as soil, sand, and so on from being introduced therein, while a wearer is sliding on playground.

BACKGROUND ART

Generally, a uniform is divided into a top and a bottom, and after the lower end periphery of the top is put into the bottom, a belt is fitted to the bottom, thereby preventing the lower end of the top from escaping from the bottom during a wearer plays sports to give no hindrance in his or her playing.

In case of sports like baseball requiring sliding, by the way, if the wearer's upper body first slides, like headfirst sliding, foreign matters like soil or sand are introduced in the upper end periphery of the bottom to which the lower end periphery of the top is put, and accordingly, the wearer has to unfasten the belt from the bottom to adjust his or her uniform. In spite of such adjustment, it is not easy to completely remove the foreign matters already introduced in the bottom, which undesirably makes him or her not focused on the sports.

So as to solve the above-mentioned problems, many solutions have been suggested, and one of them is disclosed in Korean Utility Model Application No. 1999-0021854 entitled 'sports uniform for preventing introduction of sand'.

As shown in FIG.1, the conventional uniform as disclosed in Korean Utility Model Application No. 1999-0021854 includes a long magic fastener 22 transversely attached to a top 20 corresponding to the top side of the stomach, magic fasteners 32 attached to both sides of a bottom 30 corresponding to the lower side of the stomach, and an auxiliary band 10 having magic fasteners 12 and 14 attached to a top end and both sides of a bottom end of the back surface thereof in such a manner as to stick to the magic fasteners 22 and 32.

Accordingly, the conventional uniform is configured to allow the auxiliary band 10 to cover the boundary between the top 20 and the bottom 30, so that even if the wearer slides headfirst, foreign matters like sand do not enter the bottom 30.

According to the conventional uniform, however, the magic fasteners may be separated from the uniform due to frictional forces generated upon sliding, and besides, the foreign matters like sand may be mixedly introduced in the internal surfaces of the magic fasteners, thereby undesirably making the adhesion forces of the magic fasteners gradually weakened.

Another conventional uniform is disclosed in Korean Utility Model Application No. 1998-059458 entitled 'baseball uniform', and as shown in FIG. 2, a typical baseball uniform A having a top 1 and a bottom 2, includes a cover member 4 fixed transversely only to an upper side portion of the top 1 in such a manner as to transversely cover the front surface of the top 1 located on the top side of the bottom 2 when worn and to cover a portion of the bottom 2 under a waist belt 3 and detachable means 6 like Velcro tapes attached to the lower side of the inner surface of the cover member 4 and to waist belt loops 5 of the bottom 2 corresponding thereto.

By the way, the conventional uniform as disclosed in Korean Utility Model Application No. 1998-059458 entitled 'baseball uniform', is also configured to allow the cover member 4 to cover the boundary between the top 1 and the bottom 2 to prevent foreign matters like soil or sand from entering the bottom 2, which is not different from the conventional uniform as disclosed in Korean Utility Model Application No. 1999-0021854, while still having the problems not solved.

In addition, the conventional uniforms are provided with separate outer skin cloths like the auxiliary band and the cover member located on their front surfaces, so that they cannot be finished in shape by belts, thereby making it hard to neatly adjust the uniforms.

DISCLOSURE

Technical Problem

Accordingly, the present invention has been made in view of the above-mentioned problems occurring in the prior art, and it is an object of the present invention to provide a uniform for protection from foreign matters that is configured to be lastly adjusted by means of a belt, to completely prevent foreign matters like soil and sand from being introduced therein when a wearer slides headfirst, and to suppress the foreign matter prevention function from being decreased in spite of repeated slides.

Technical Solution

To accomplish the above-mentioned object, according to the present invention, there is provided a uniform for protection from foreign matters in such a manner as to be separated into a top and a bottom, the uniform including: the top having a non-exposed lower part having side slits and an exposed upper part having no side slits, the non-exposed part having a back surface portion located on the back side thereof with respect to the side slits in such a manner as to be inserted into the bottom at the time when the uniform is worn and a front surface portion located on the front side thereof with respect to the side slits in such a manner as to be disposed on the outside of the bottom at the time when the uniform is worn, the front surface portion having at least two or more pulling slots formed long in up and down directions on the upper side thereof in such a manner as to pull out belt loops disposed on the bottom toward the outside of the top and first fixing members disposed on the lower side thereof under the pulling slots, and the bottom having second fixing members disposed thereon in such a manner as to correspond to the first fixing members, wherein in a state where the lower side of the front surface portion of the top under the pulling slots is folded, the first fixing members are fastened or attached to the second fixing members of the bottom, so that the lower side of the front surface portion is fixed to the bottom.

According to the present invention, desirably, the top 100 further comprises adjusting buttons 131 disposed above the side slits 130 to adjust the lengths of the side slits 130.

According to the present invention, desirably, the front surface portion 121 further comprises cover members 140 adapted to cover the pulling slots 121*a* in such a manner as to allow top ends thereof to be fixed thereto by means of back stitches and slits 121*b* adapted to insert the lower ends of the cover members 140 thereinto. At this time, Velcro tapes 330 are provided on both sides of the inner surfaces of the cover members 140 and the outer surfaces of both sides of the pulling slots 121*a* of the front surface portion 121 coming into contact with the cover members 140, and further, Velcro tapes 330 are provided on the outer surfaces of the lower ends of the cover members 140 and the inner surfaces of the front surface portion 121, with which the lower ends of the cover members 140 come into contact after inserted into the slits 121*b*.

Advantageous Effects

As mentioned above, the uniform for protection from foreign matters according to the present invention is configured to allow the front surface portion and the back surface portion of the top to be differently located inside and outside the bottom by means of the side slits to prevent foreign matters from being introduced therein upon both of the bent leg sliding and the headfirst sliding, to allow the top and the bottom to be fixed to each other by means of the belt, and to allow the lower side of the front surface portion of the top to be folded inwardly and fixed to the bottom, thereby preventing the uniform from getting easily loose to make the wearer focused on the sports.

Further, the uniform for protection from foreign matters according to the present invention is configured to allow the bottom to be fixed to the top by means of the belt fitted to the belt loops of the bottom in the state where the upper side of the bottom is covered with the front surface portion of the top, so that in spite of repeated slides, the state where the upper side of the bottom is covered with the front surface portion of the top is maintained, thereby continuously providing the foreign matter prevention function.

DESCRIPTION OF DRAWINGS

FIGS. 6*a* to 7*b* are front and sectional views showing uniforms according to embodiments of the present invention.

BEST MODE FOR INVENTION

The present invention relates to a functional uniform for preventing foreign matters from being introduced therein, while a wearer is playing sports, and the uniform, which is separated into a top and a bottom, includes: the top having a non-exposed lower part having side slits and an exposed upper part having no side slits, the non-exposed part having a back surface portion located on the back side thereof with respect to the side slits in such a manner as to be inserted into the bottom at the time when the uniform is worn and a front surface portion located on the front side thereof with respect to the side slits in such a manner as to be disposed on the outside of the bottom at the time when the uniform is worn, the front surface portion having at least two or more pulling slots formed long in up and down directions on the upper side thereof in such a manner as to pull out belt loops disposed on the bottom toward the outside of the top and first fixing members disposed on the lower side thereof under the pulling slots, and the bottom having second fixing members disposed thereon in such a manner as to correspond to the first fixing members, wherein in a state where the lower side of the front surface portion of the top under the pulling slots is folded, the first fixing members are fastened or attached to the second fixing members of the bottom, so that the lower side of the front surface portion is fixed to the bottom.

Mode for Invention

Hereinafter, the present invention will be in detail explained with reference to the attached drawings. On the other hand , if it is determined that the detailed explanation on the well known technology related to the present invention makes the scope of the present invention not clear, the explanation will be avoided for the brevity of the description.

Figure 1:
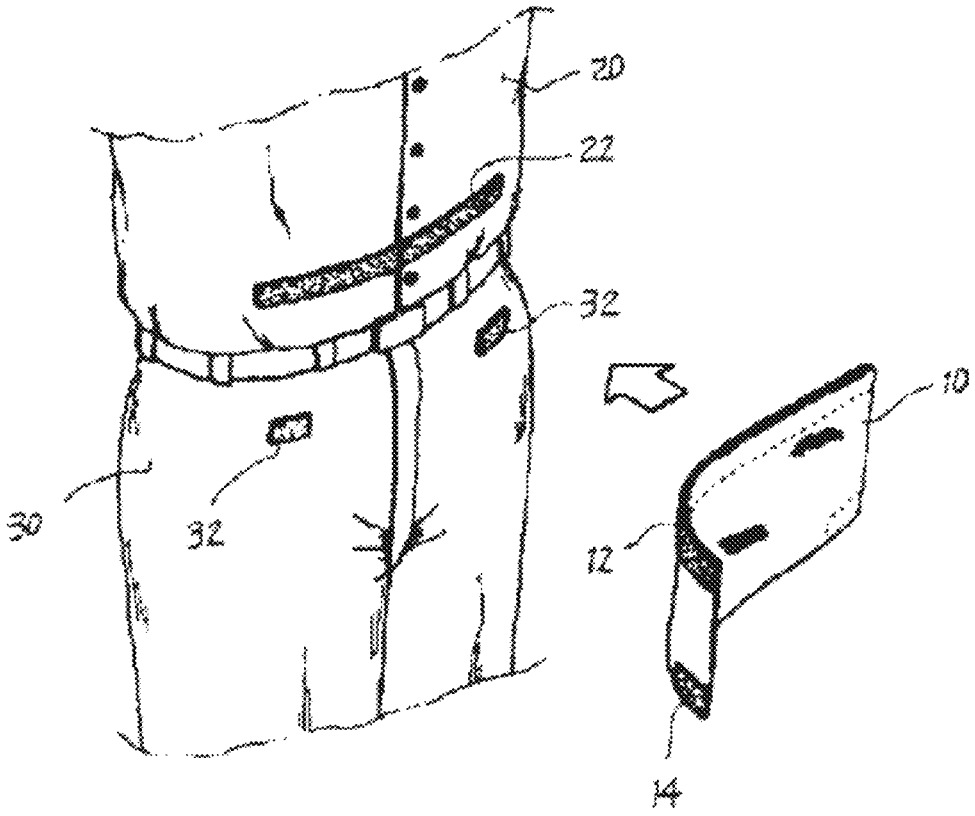
FIG. 1 is a perspective view showing a conventional sports uniform for protection from sand.
Figure 2:
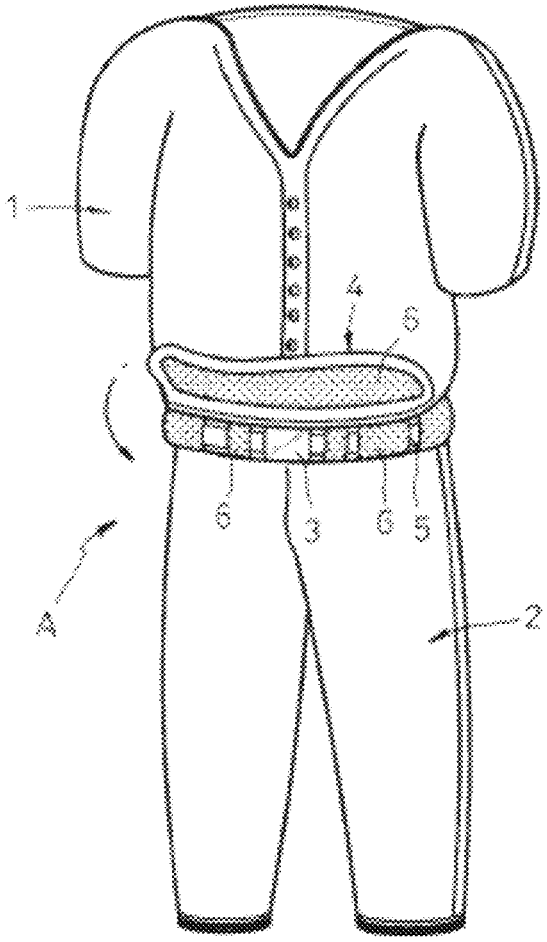
FIG. 2 is a perspective view showing another conventional baseball uniform.
Figure 3:
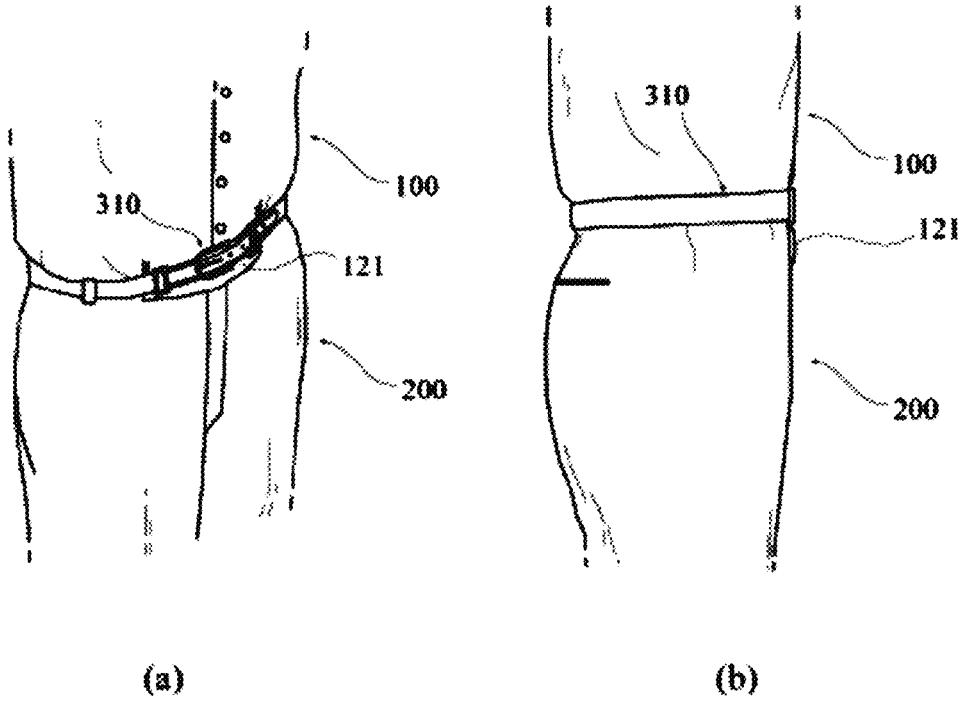
FIGS. 3*a* and 3*b* are front and side views showing a wearer who wears a uniform for protection from foreign matters according to an embodiment of the present invention.
Figure 4:
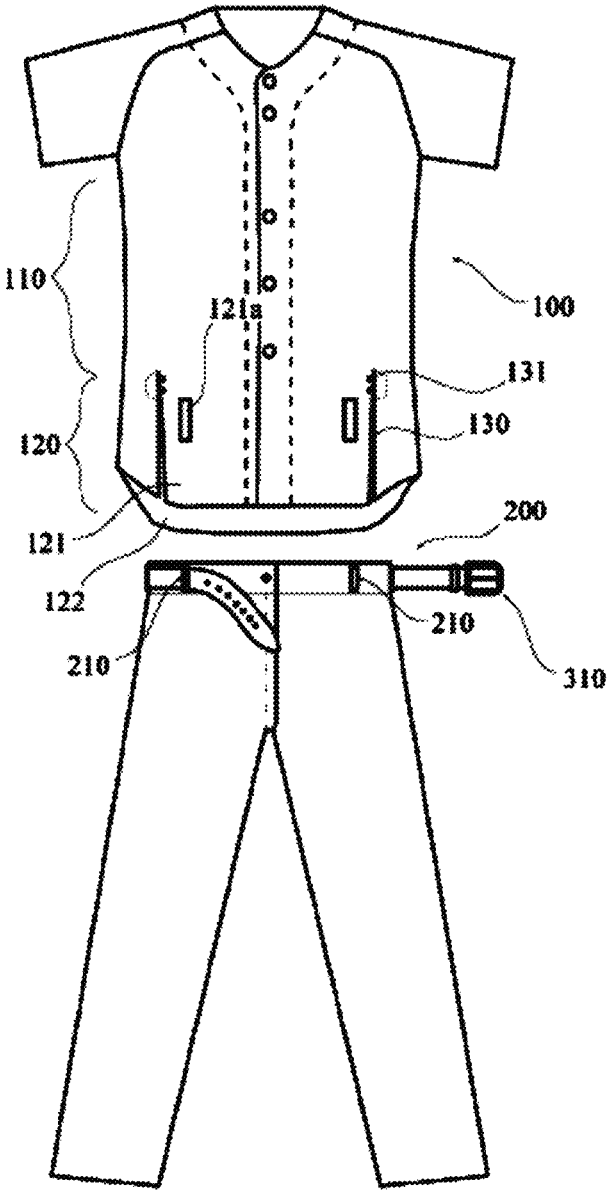
FIG. 4 is a front view showing the uniform according to the present invention which is separated into a top and a bottom.

FIGS. 3*a* and 3*b* are front and side views showing a wearer who wears a uniform for protection from foreign matters according to an embodiment of the present invention, and FIG.4 is a front view showing the uniform according to the present invention which is separated into a top 100 and a bottom 200.

As shown in FIG.4, the uniform according to the present invention is separated into the top 100 and the bottom 200, and the top 100 includes a non-exposed lower part 120 adapted to be inserted or folded into the bottom 200 in such a manner as to be not exposed to the outside and an exposed upper part 110 disposed above the bottom 200.

Further, the non-exposed part 120 includes side slits 130 formed long on both sides of the top 100, that is, the ribs of the wearer, and accordingly, the non-exposed part 120 is divided into a front surface portion 121 located on the front side thereof with respect to the side slits 130 and a back surface portion 122 located on the back side thereof with respect to the side slits 130.

In the same manner as a general uniform, at the time when the uniform is worn, the back surface portion 122 is inserted into the bottom 200, and in this state, a belt 310 is fitted to belt loops 210 disposed on the bottom 200.

At the time when the uniform is worn, contrarily, the front surface portion 121 of the non-exposed part 120 is located on the outside of the bottom 200, so that it can prevent foreign matters like soil, sand, and so on from being introduced in the bottom 200 when the wearer slides head-first.

Like this, the side slits 130 serve to allow the front surface portion 121 and the back surface portion 122 of the top 100 to be located inside and outside the bottom 200, thereby making it possible to prevent foreign matters from being introduced in the uniform at the time of both of bent leg sliding wherein a slide occurs in the order of the legs and the buttocks and headfirst sliding wherein a slide occurs in the order of the head, the chest, and the stomach.

The lengths of the side slits 130 may be varied in accordance with the wearer's physical characteristics, and desirably, the top points of the side slits 130 correspond to the top ends of the belt loops 210 drawn from pulling slots

121*a* as will be discussed later. Accordingly, adjusting buttons 131 are further disposed above the side slits 130 to adjust the lengths of the side slits 130.

On the other hand, the front surface portion 121 of the non-exposed part 120 has at least two or more pulling slots 121*a* formed long in up and down directions on the upper side thereof. The pulling slots 121*a* serve to pull out the belt loops 210 disposed on the bottom 200 toward the outside of the top 100.

Accordingly, the widths of the pulling slots 121*a* are greater than or equal to the widths of the belt loops 210, and since the top and bottom positions of the belt 310 are varied according to the wearer's physical characteristics, desirably, the lengths of the pulling slots 121*a* are longer than the lengths of the belt loops 210.

Figure 5:
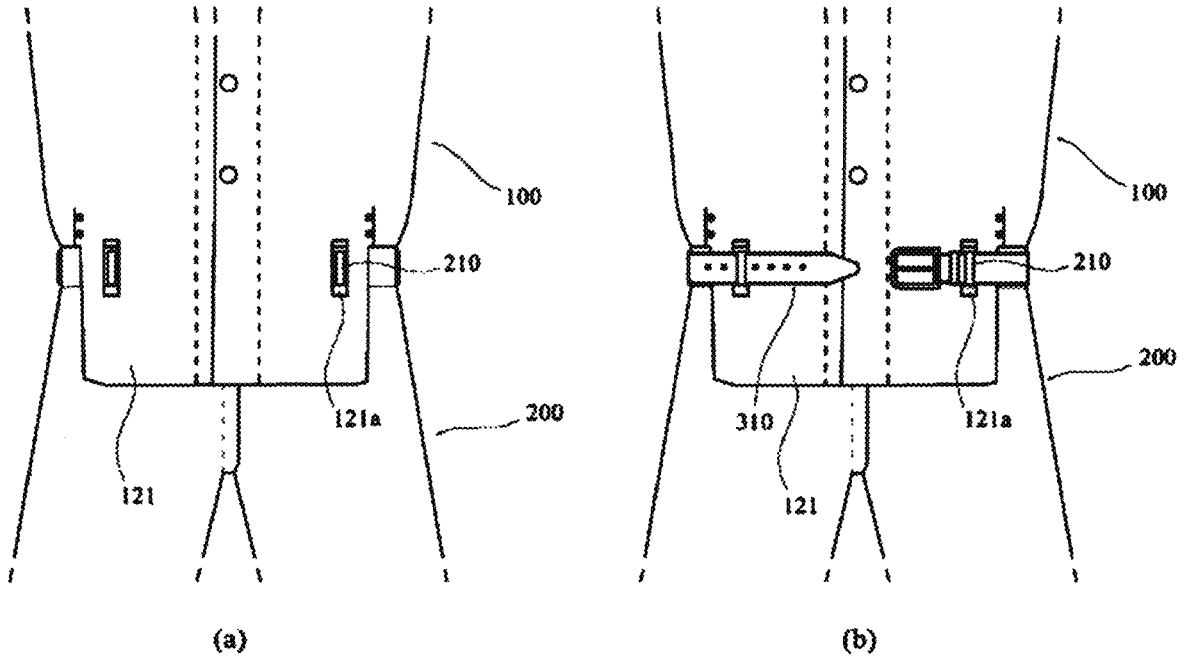
FIGS. 5*a* and 5*b* are partially front views showing some of processes for wearing the uniform according to the present invention.

FIGS. 5*a* and 5*b* show a process of wearing the front surface portion 121 of the top 100 together with the bottom 200, wherein FIG. 5*a* shows a state where the belt loops 210 of the bottom 200 are pulled out to the outside of the top 100 through the pulling slots 121*a* and FIG. 5*b* shows a state where the belt 310 is fitted to the belt loops 210 pulled out to the outside of the top 100 through the pulling slots 121*a*.

Like this, the upper portion of the bottom 200 is covered with the front surface portion 121 of the top 100 and is then fastened by the belt 310, and even if the wearer slides head-first, accordingly, foreign matters like soil or sand may be not introduced at all in the bottom 200.

On the other hand, if the lengths of the pulling slots 121*a* are longer than the lengths of the belt loops 210, it is possible that the uniform according to the present invention is generally used according to various physical characteristics of wearers, but if a difference between the lengths is big, the outer appearance of the uniform may become bad. Besides, the belt loops 210 are locked onto the pulling slots 121*a* to cause the pulling slots 121*a* to be torn off, thereby lowering the durability of the uniform. According to another embodiment of the present invention, therefore, cover members 140 for protecting the pulling slots 121*a* are further provided.

Figure 6:
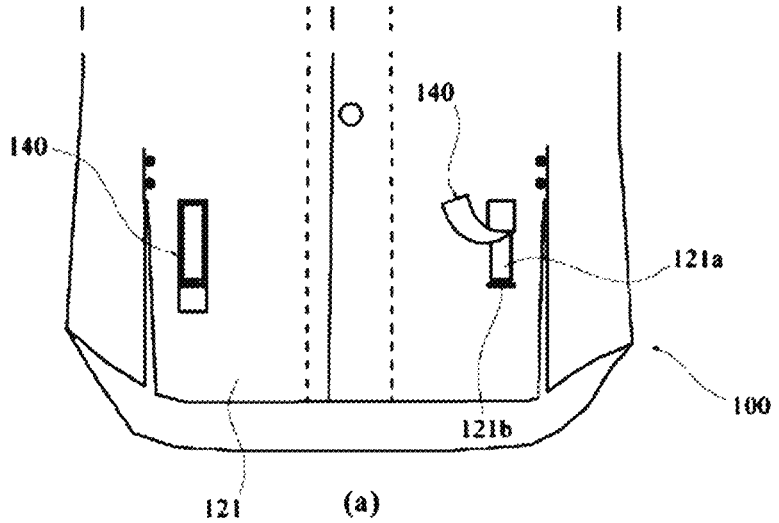
Figure 6:
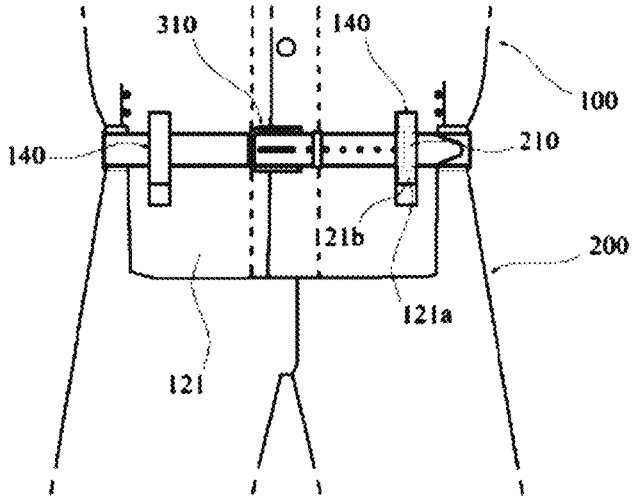

FIGS. 6*a* and 6*b* show the top 100 having the cover members 140, wherein FIG. 6*a* shows a state where the cover members 140 are provided and FIG. 6*b* shows a state where the belt 310 is fitted to the uniform having the cover members 140.

The cover members 140 are larger than the pulling slots 121*s* so as to cover the pulling slots 121*a*. The top ends of the cover members 140 are fixed to the front surface portion 121 by means of back stitches, but the bottom ends thereof are freely detached from the front surface portion 121.

The detachable structures of the cover members 140 may be varied. According to the present invention, desirably, slits 121*b* are formed under the pulling slots 121*a* of the front surface portion 121, and the lower ends of the cover members 140 are fixedly inserted into the slits 121*b*.

Figure 7:
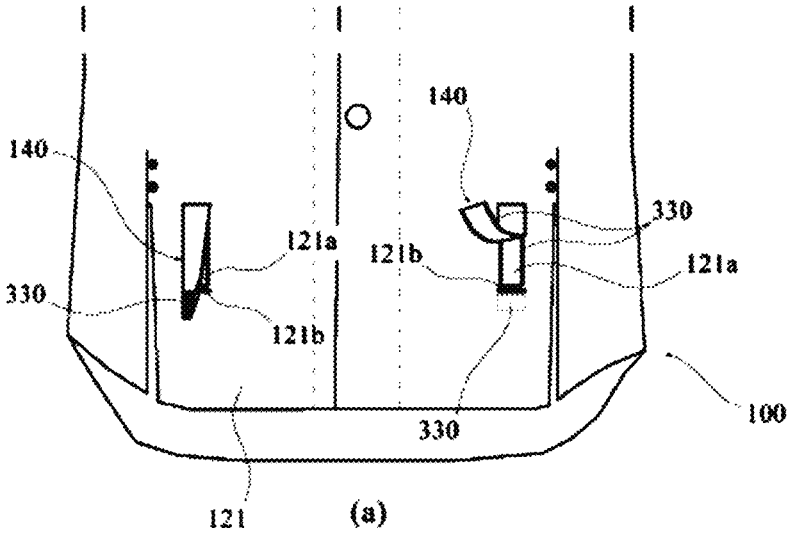
Figure 7:
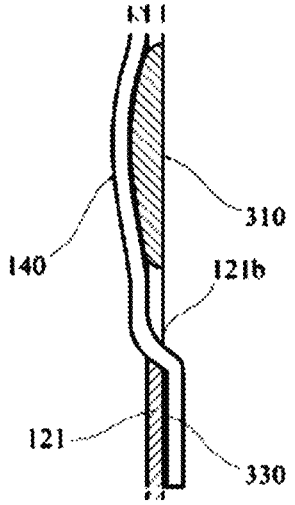

The lengths of the cover member lower ends inserted into the slits 121*b* are long so that at the time when the front surface portion 121 under the pulling slots 121*a* are folded inside the bottom 200, which will be discussed later, the lower ends of the cover members 140 are folded together with the front surface portion 121. According to yet another embodiment of the present invention, as shown in FIGS. 7*a* and 7*b*, Velcro tapes 330 are provided on the outer surfaces of the lower ends of the cover members 140 and the inner surfaces of the front surface portion 121, with which the lower ends of the cover members 140 come into contact after inserted into the slits 121*b*, so that they are attached to each other, thereby preventing the lower ends of the cover members 140 from easily escaping from the slits 121*b*.

Further, Velcro tapes 330 are provided on both sides of the inner surfaces of the cover members 140 and the outer surfaces of both sides of the pulling slots 121*a* of the front surface portion 121 coming into contact with the cover members 140, so that they are attached to each other to block the entire portion of the pulling slots 121*a* except portions through which the belt 310 passes, thereby preventing foreign matters from being introduced in the uniform.

As shown in FIG. 5*b*, if the belt 310 is just fitted to the outside of the front surface portion 121 of the top 100, the lower portion of the front surface portion 121 is not fixed, but freely waved, so that it hinders the wearer's agile action. Therefore, the lower side of the front surface portion 121 under the pulling slots 121*a* is foldedly fixed to the bottom 200.

Figure 8:
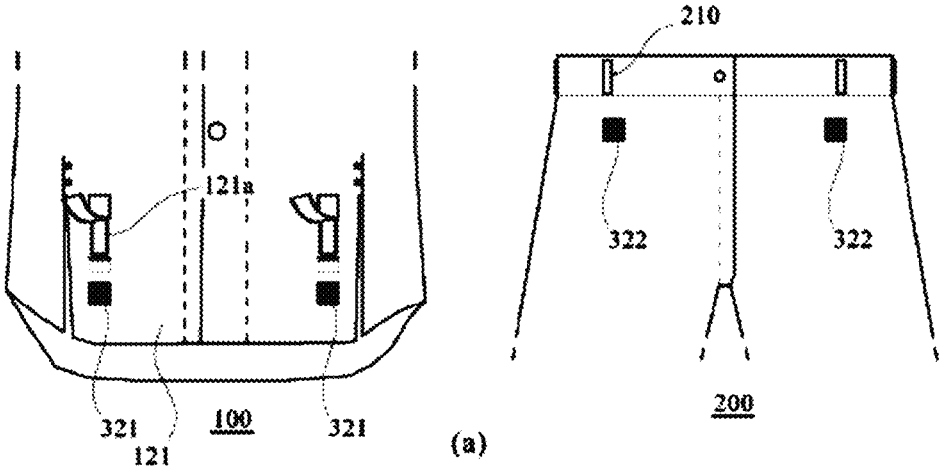
FIGS. 8*a* and 8*b* are front and side views showing means for fixing a front surface portion of the top of the uniform according to the present invention.
Figure 8:
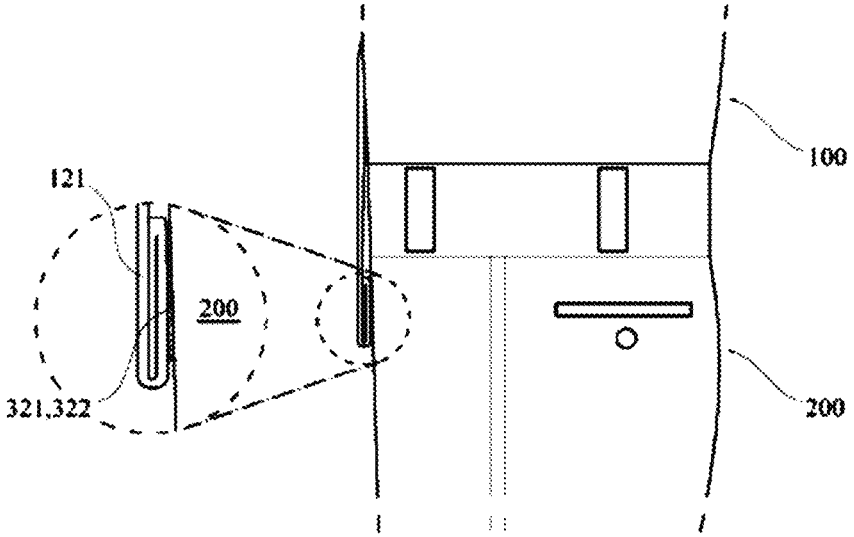

To do this, as shown in FIGS. 8*a* and 8*b*, first fixing members 321 are disposed on the lower sides of the front surface portion 121 under the pulling slots 121*a*, and further, second fixing members 322 are disposed on the bottom 200 in such a manner as to correspond to the first fixing members 321.

In the state where the lower side of the front surface portion 121 under the pulling slots 121*a* is folded, the first fixing members 321 are fastened or attached to the second fixing members 322 of the bottom 200. The first fixing members 321 and the second fixing members 322 are provided to the form of buttons or Velcro tapes.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The present invention relates to the functional uniform for preventing foreign matters from being introduced therein, while the wearer is playing sports, which is applicable to industrial fields related thereto.

What is claimed is:

1. A uniform for protection from foreign matters, the uniform comprising:

a top (100); and a bottom (200), where the top and the bottom are separated from each other, the top (100) having a non-exposed lower part (120) having side slits (130) and an exposed upper part (110) having no side slits (130), wherein the non-exposed part (120) comprises a back surface portion (122) located on a back side thereof with respect to the side slits (130) in such a manner as to be inserted into the bottom (200), and a front surface portion (121) located on a front side thereof with respect to the side slits (130) in such a manner as to be disposed on an outside of the bottom (200)

wherein the front surface portion (121) comprises at least two or more pulling slots (121*a*) formed long in up and down directions on an upper side thereof in such a manner as to pull out belt loops (210) disposed on the bottom (200) toward an outside of the top (100), cover members (140) larger than the pulling slots to cover the pulling slots (121*a*) in such a manner as to allow top ends thereof to be fixed to the front surface portion (121) by means of back stitches, wherein bottom ends of the cover members are detachable from the front surface portion, slits (121*b*) adapted to insert the bottom ends of the cover members (140) thereinto, and first fixing members (321) disposed on a lower side thereof under the pulling slots (121*a*), and the bottom (200) having second fixing members (322) disposed thereon in such a manner as to correspond to the first fixing members (321), wherein in a state where the lower side of the front surface portion (121) of the top (100) under the pulling slots (121*a*) is folded, the first fixing members (321) are fastened or attached to the second fixing members (322) of the bottom (200), so that the lower side of the front surface portion (121) is fixed to the bottom (200).

2. The uniform according to claim 1, wherein the top (100) further comprises adjusting buttons (131) disposed above the side slits (130) to adjust the a length of the side slits (130).

3. The uniform according to claim 1, wherein fastening tapes (330) are provided on both sides of inner surfaces of the cover members (140) and outer surfaces of both sides of the pulling slots (121*a*) of the front surface portion (121) coming into contact with the cover members (140), so that the fastening tapes (330) are attached to each other.

4. The uniform according to claim 1, wherein the fastening tapes (330) are provided on outer surfaces of the bottom ends of the cover members (140) and inner surfaces of the front surface portion (121), with which the bottom ends of the cover members (140) come into contact after inserted into the slits (121*b*), so that the fastening tapes (330) are attached to each other.

* * * * *